US009573604B2

(12) United States Patent
Nishimura et al.

(10) Patent No.: US 9,573,604 B2
(45) Date of Patent: Feb. 21, 2017

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP); Takeyoshi Kusunoki, Akashi (JP); Yasufumi Okumura, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/089,023

(22) Filed: Apr. 1, 2016

(65) Prior Publication Data

US 2016/0214627 A1 Jul. 28, 2016

Related U.S. Application Data

(63) Continuation of application No. 14/232,354, filed as application No. PCT/JP2012/004513 on Jul. 12, 2012, now Pat. No. 9,358,989.

(30) Foreign Application Priority Data

Jul. 14, 2011 (JP) ..... 2011-155608
Mar. 29, 2012 (JP) ..... 2012-076653

(51) Int. Cl.
*B61F 5/00* (2006.01)
*B61F 5/30* (2006.01)
(Continued)

(52) U.S. Cl.
CPC . *B61F 5/30* (2013.01); *B61F 3/04* (2013.01); *B61F 5/00* (2013.01); *B61F 5/302* (2013.01); *B61F 5/52* (2013.01); *B61F 15/06* (2013.01)

(58) Field of Classification Search
CPC ..... B61F 5/00; B61F 5/52; B61F 5/302; B61F 5/50; B61F 5/301; B61F 5/325; B61F 5/144; B61F 5/30; B61F 5/24; B61F 5/148; B61F 3/04; B61F 3/02
See application file for complete search history.

(56) References Cited

U.S. PATENT DOCUMENTS 2,097,418 A 10/1937 Oelkers
3,948,188 A 4/1976 Zehnder
(Continued)

FOREIGN PATENT DOCUMENTS

EP 0601677 A1 6/1994
JP 47-000654 A 1/1972
(Continued)

OTHER PUBLICATIONS

May 27, 2015 Office Action issued in Chinese Patent Application No. 2012800333757.
(Continued)

*Primary Examiner* — Jason C Smith
(74) *Attorney, Agent, or Firm* — Oliff PLC

(57) ABSTRACT

A railcar bogie includes: a cross beam supporting a carbody; a pair of front and rear axles sandwiching and arranged in front of and behind the cross beam in a railcar longitudinal direction to extend in a railcar width direction; bearings provided at both railcar width direction sides of each and rotatably supporting the axles; axle boxes accommodating the bearings; side members extending in the railcar longitudinal direction supporting both railcar width direction end portions of the cross beam and each including both railcar longitudinal direction end portions supported by the axle boxes; contact members provided at both railcar width direction end portions and disposed on railcar longitudinal direction middle portions of the side members so as not to be fixed to the side members in an upper-lower direction;
(Continued)

and supporting members provided at the axle boxes and supporting the railcar longitudinal direction end portions of the side members.

5 Claims, 12 Drawing Sheets

(51) Int. Cl.
*B61F 5/52* (2006.01)
*B61F 3/04* (2006.01)
*B61F 15/06* (2006.01)

(56) References Cited

U.S. PATENT DOCUMENTS 4,237,791 A * 12/1980 Jackson ..... B61F 5/305 105/168
4,238,006 A * 12/1980 Jackson ..... B61F 5/305 105/168
4,538,524 A * 9/1985 Eggert, Jr. ..... B61F 3/04 105/182.1
4,676,173 A * 6/1987 Mielcarek ..... B61F 5/144 105/182.1
5,335,602 A * 8/1994 Richter ..... B61F 5/44 105/168
6,053,112 A * 4/2000 Jones, Jr. ..... B61F 5/50 105/157.1
6,250,232 B1 * 6/2001 Hachmann ..... B61F 5/325 105/157.1
6,305,297 B1 * 10/2001 Landrot ..... B61F 5/302 105/157.1
6,338,300 B1 * 1/2002 Landrot ..... B61F 5/305 105/182.1
6,363,861 B1 * 4/2002 Strehler ..... B61C 9/50 105/133
7,328,660 B2 2/2008 Landrot
8,656,839 B2 * 2/2014 Nishimura ..... B61C 9/50 105/182.1
8,844,447 B2 * 9/2014 Goding ..... B61F 5/52 105/172
2005/0116436 A1 6/2005 Landrot
2010/0186620 A1 * 7/2010 Rodet ..... B61D 13/00 105/182.1
2010/0294164 A1 * 11/2010 Oku ..... B61D 13/00 105/182.1
2011/0239899 A1 * 10/2011 Okubo ..... B61F 5/38 105/185
2012/0037033 A1 * 2/2012 Halford ..... B61F 3/02 105/182.1
2012/0060719 A1 * 3/2012 Nishimura ..... B61D 13/00 105/182.1
2013/0333590 A1 * 12/2013 Rodet ..... B61F 5/50 105/182.1
2014/0137765 A1 * 5/2014 Nishimura ..... B61F 5/52 105/182.1

FOREIGN PATENT DOCUMENTS

JP S55-11365 U 1/1980
JP S55-47950 A 4/1980
JP S61-143257 A 6/1986
JP H04-197873 A 7/1992
JP 2799078 B2 9/1998

OTHER PUBLICATIONS

Sep. 10, 2015 Office Action issued in U.S Appl. No. 14/232,354.
U.S. Appl. No. 14/232,354, filed Jan. 13, 2014 in the name of Nishimura et al.
Oct. 23, 2012 International Search Report issued in International Patent Application No. PCT/JP2012/004513.

* cited by examiner

RAILCAR BOGIE

This is a Continuation of U.S. application Ser. No. 14/232,354 filed Jan. 13, 2014, which is a National Phase of International Application No. PCT/JP2012/004513 filed Jul. 12, 2012, and claims the benefit of Japanese Application No. 2011-155608 filed Jul. 14, 2011 and Japanese Application No. 2012-076653 filed Mar. 29, 2012. The disclosures of the prior applications are hereby incorporated by reference herein in their entireties.

TECHNICAL FIELD

The present invention relates to a railcar bogie.

BACKGROUND ART

A bogie for supporting a carbody of a railcar and allowing the railcar to run along a rail is provided under a floor of the carbody. In the bogie, axle boxes each configured to store a bearing for supporting an axle are supported by an axlebox suspension so as to be displaceable relative to a bogie frame in a vertical direction. For example, PTL 1 proposes the axlebox suspension, and the bogie frame includes a cross beam extending in a crosswise direction and a pair of left and right side sills respectively extending from both end portions of the cross beam in a front-rear direction. The axlebox suspension includes axle springs constituted by coil springs each provided between the axle box and the side sill located above the axle box.

PTL 2 proposes the bogie in which the side sills are omitted from the bogie frame.

CITATION LIST

Patent Literature

PTL 1: Japanese Patent No. 2799078

PTL 2: Japanese Laid-Open Patent Application Publication No. 55-47950

SUMMARY OF INVENTION

Technical Problem

In the bogie of PTL 1, the bogie frame constituted by the cross beam and the side sills is manufactured by welding heavy steel members to one another. Therefore, problems are that the weight of the bogie frame becomes heavy, and the cost for the steel members and the assembly cost become high.

In the bogie of PTL 2, the cross beam of the bogie frame and each axle box are connected to each other by a suspension member so as to be spaced apart from each other by a certain distance. In addition, front-rear direction middle portions of plate springs are respectively held by and fixed to both crosswise direction end portions of the cross beam, and both front-rear direction end portions of each plate spring are respectively inserted in spring receiving portions respectively provided at lower portions of the axle boxes.

In the case of the bogie of PTL 2, square tube-shaped attaching portions are respectively provided at both crosswise direction end portions of the cross beam, and the front-rear direction middle portions of the plate springs are respectively inserted through hollow portions of the attaching portions. Then, each plate spring is positioned and fixed by arranging a spacer at a gap between the attaching portion and the plate spring. Therefore, the bogie of PTL 2 is complex in structure and low in assembly workability. The entire periphery of the front-rear direction middle portion of the plate spring is held by and fixed to the attaching portion of the cross beam. Therefore, a torsional force is transmitted between the cross beam and the plate spring. However, if respective members are increased in strength and the bogie is reinforced as countermeasures against the torsion, the weight of the bogie increases.

Here, an object of the present invention is to improve assembly workability of the bogie while simplifying the bogie and reducing the weight of the bogie.

Solution to Problem

A railcar bogie according to the present invention includes: a cross beam configured to support a carbody of a railcar; a pair of front and rear axles sandwiching the cross beam and respectively arranged in front of and behind the cross beam in a railcar longitudinal direction so as to extend in a railcar width direction; bearings respectively provided at both railcar width direction sides of each of the axles and configured to rotatably support the axles; axle boxes configured to respectively accommodate the bearings; side members extending in the railcar longitudinal direction so as to respectively support both railcar width direction end portions of the cross beam and each including both railcar longitudinal direction end portions respectively supported by the axle boxes; contact members respectively provided at both railcar width direction end portions of the cross beam and respectively disposed on railcar longitudinal direction middle portions of the side members so as not to be fixed to the side members in an upper-lower direction; and supporting members respectively provided at the axle boxes and respectively supporting the railcar longitudinal direction end portions of the side members.

According to the above configuration, the contact members respectively provided at both railcar width direction end portions of the cross beam are respectively disposed on the railcar longitudinal direction middle portions of the side members from above so as not to be fixed to the side members in the upper-lower direction. Therefore, a supporting structure between the side member and the cross beam is simplified, and the assembly workability of the bogie significantly improves. Further, the contact member of the cross beam is not fixed to the side member in the upper-lower direction. Therefore, the torsional force is transmitted little between the cross beam and the side member. On this account, it is unnecessary to increase the strengths of respective members and reinforce the bogie as countermeasures against the torsion. Thus, the weight reduction of the bogie can be accelerated.

Advantageous Effects of Invention

As is clear from the above explanations, according to the present invention, the assembly workability of the bogie can be improved while simplifying the bogie and reducing the weight of the bogie.

DESCRIPTION OF EMBODIMENTS

Hereinafter, embodiments according to the present invention will be explained in reference to the drawings.

Embodiment 1

Figure 1:
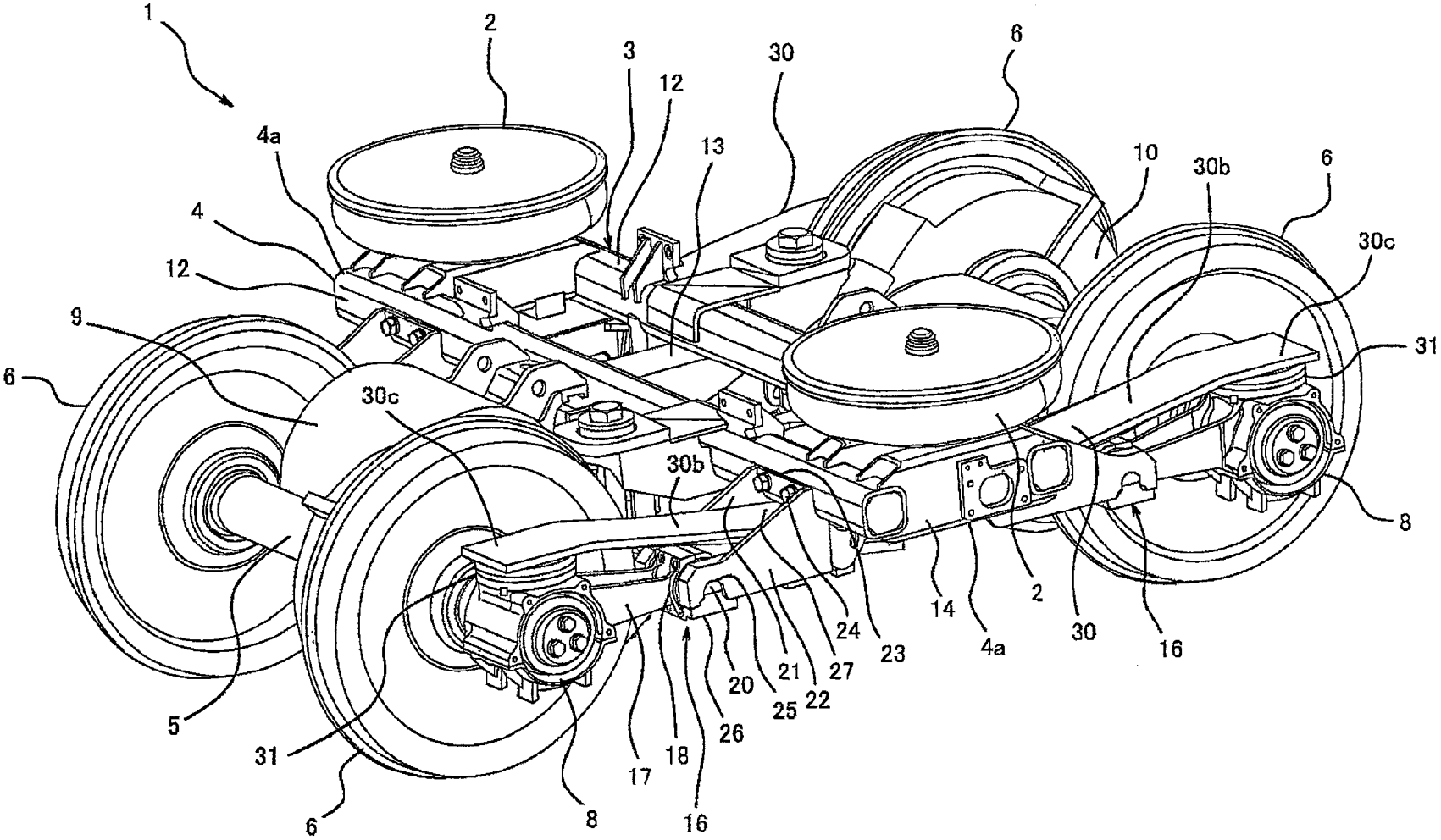
FIG. 1 is a perspective view showing a railcar bogie according to Embodiment 1 of the present invention.
Figure 2:
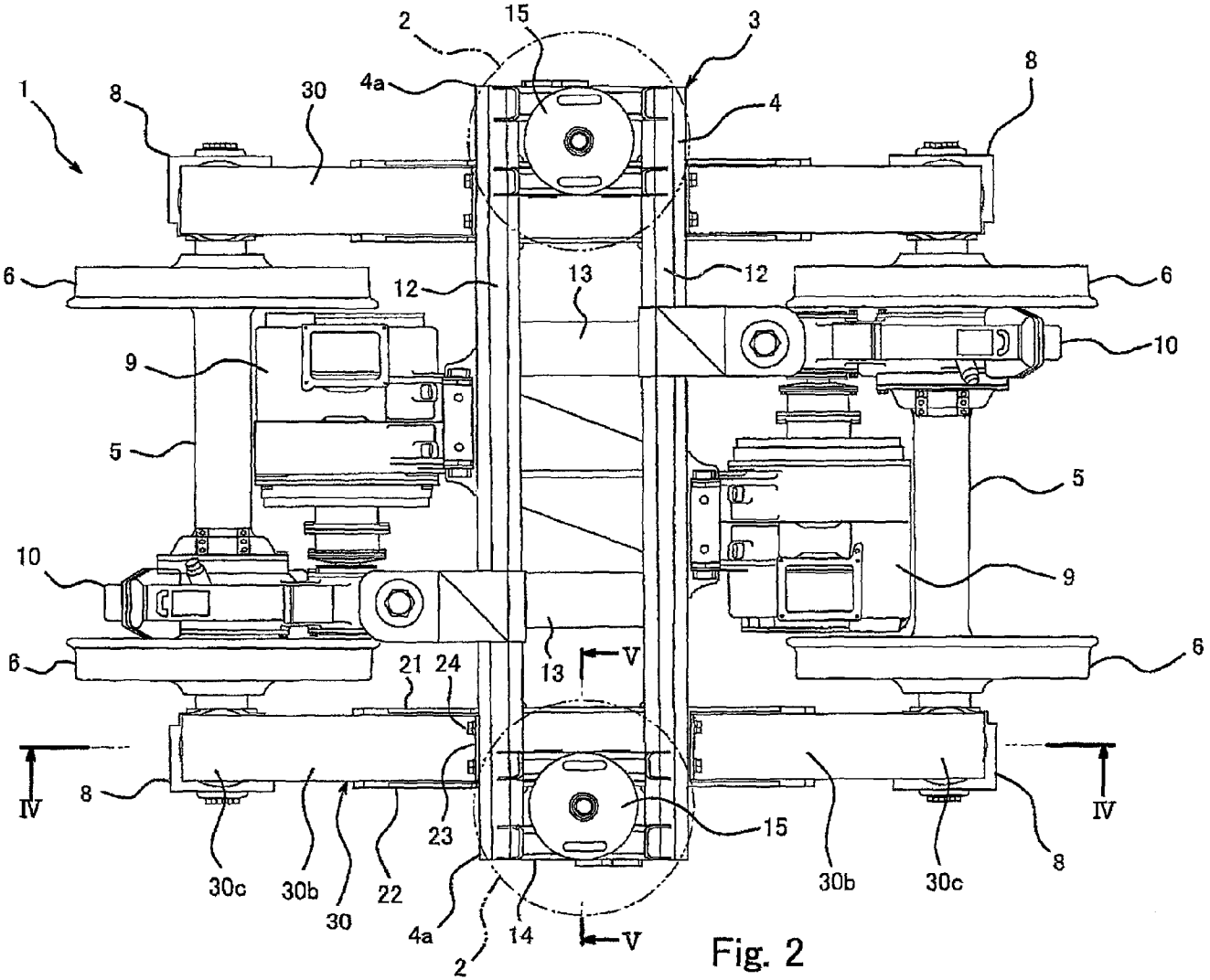
FIG. 2 is a plan view of the bogie shown in FIG. 1.
Figure 3:
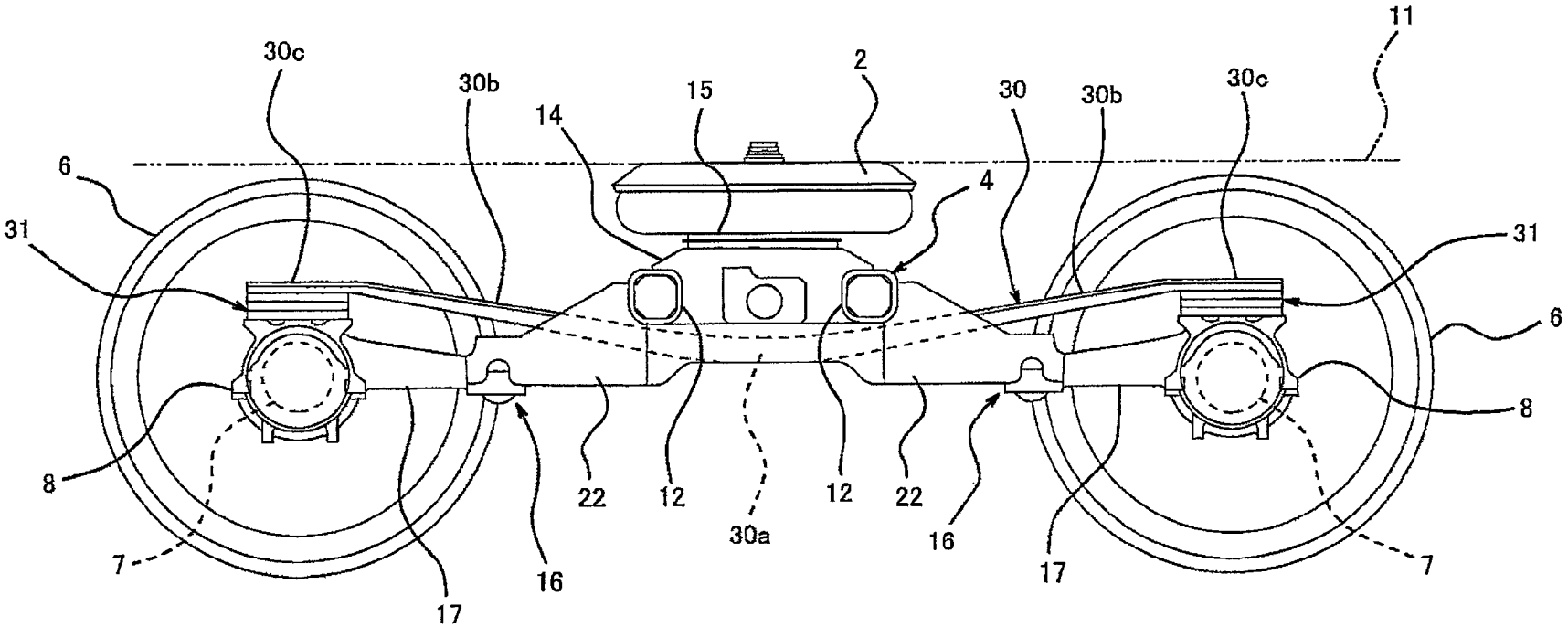
FIG. 3 is a side view of the bogie shown in FIG. 1.

FIG. 1 is a perspective view showing a railcar bogie 1 according to Embodiment 1 of the present invention. FIG. 2 is a plan view of the bogie 1 shown in FIG. 1 and including plate springs. FIG. 3 is a side view of the bogie 1 shown in FIG. 1. As shown in FIGS. 1 to 3, the railcar bogie 1 includes a cross beam 4 extending in a railcar width direction (hereinafter also referred to as a "crosswise direction") as a bogie frame 3 configured to support a carbody 11 via air springs 2 serving as secondary suspensions. However, the railcar bogie 1 does not include side sills respectively extending from both crosswise direction end portions of the cross beam 4 in a railcar longitudinal direction (hereinafter also referred to as a "front-rear direction"). A pair of front and rear axles 5 are respectively arranged in front of and behind the cross beam 4 so as to extend in the crosswise direction. Wheels 6 are respectively fixed to both crosswise direction sides of each axle 5. Bearings 7 configured to rotatably support the axle 5 are respectively provided at both crosswise direction end portions of the axle 5 so as to be respectively located outside the wheels 6 in the crosswise direction. The bearings 7 are respectively accommodated in axle boxes 8. An electric motor 9 is attached to the cross beam 4, and a gear box 10 that accommodates a reduction gear configured to transmit power to the axles 5 is connected to an output shaft of the electric motor 9. A braking device (not shown) configured to brake the rotations of the wheels 6 is also provided at the cross beam 4.

The cross beam 4 includes: a pair of square pipes 12 extending in the crosswise direction and made of metal; and connecting plates 13 and 14 connecting the square pipes 12 and made of metal. The connecting plates 13 and 14 are fixed to the square pipes 12 by welding, bolts, or the like. A pair of tubular connecting plates 14 are provided at each of crosswise direction end portions 4*a* of the cross beam 4 so as to be spaced apart from each other. Each of air spring bases 15 is disposed on upper surfaces of the pair of connecting plates 14. A crosswise direction length of the cross beam 4 is larger than a distance between the axle box 8 at a left side and the axle box 8 at a right side (that is, the cross beam 4 is projecting from each axle box 8 in the railcar width direction).

Each of the crosswise direction end portions 4*a* of the cross beam 4 is coupled to the axle boxes 8 by coupling mechanisms 16. Each of the coupling mechanism 16 includes an axle arm 17 extending in the front-rear direction integrally from the axle box 8. A tubular portion 18 that has a cylindrical inner peripheral surface and opens at both crosswise direction sides thereof is provided at an end portion of each axle arm 17. A core rod 20 is inserted in an internal space of each tubular portion 18 via a rubber bushing (not shown). A pair of receiving seats 21 and 22 constituting the coupling mechanism 16 are provided at the crosswise direction end portion 4*a* of the cross beam 4 so as to project in the front-rear direction. Upper end portions of the pair of receiving seats 21 and 22 are coupled to each other by a coupling plate 23, and the coupling plate 23 is fixed to the square pipe 12 by bolts 24. A fitting groove 25 that opens downward is formed at each of the receiving seats 21 and 22. Both crosswise direction end portions of the core rod 20 are respectively fitted into the fitting grooves 25 of the receiving seats 21 and 22 from below. In this state, a lid member 26 is fixed to the receiving seats 21 and 22 by bolts (not shown) from below so as to close lower openings of the fitting grooves 25 of the receiving seats 21 and 22. Thus, the core rod 20 is supported by the lid member 26 from below.

Each of plate springs 30 (side members) extending in the front-rear direction is provided between the cross beam 4 and the axle box 8. Front-rear direction middle portions 30*a* of the plate springs 30 respectively support the crosswise direction end portions 4*a* of the cross beam 4, and front-rear direction end portions 30*c* of the plate springs 30 are respectively supported by the axle boxes 8. To be specific, each of the plate springs 30 serves as both a primary suspension and a conventional side sill. Supporting members 31 are respectively attached to upper end portions of the axle boxes 8, and the front-rear direction end portions 30*c* of the plate springs 30 are respectively supported by the supporting members 31 from below. The front-rear direction middle portions 30*a* of the plate springs 30 are arranged under the cross beam 4, and contact members 33 (see FIG. 4) respectively provided at the crosswise direction end portions 4*a* of the cross beam 4 are respectively disposed on the front-rear direction middle portions 30*a* of the plate springs 30 from above.

In the plate spring 30, each of extending portions 30*b* each extending between the front-rear direction middle portion 30*a* and the front-rear direction end portion 30*c* is inclined downward toward the front-rear direction middle portion 30*a* in a side view. The front-rear direction middle portion 30*a* of the plate spring 30 is located at a position lower than the front-rear direction end portions 30*c* of the plate spring 30. To be specific, the plate spring 30 is formed in an arch shape that is convex downward as a whole in a side view. A part of each of the extending portions 30*b* of the plate spring 30 is arranged so as to overlap the coupling mechanism 16 in a side view. The plate spring 30 is arranged so as to be spaced apart from the coupling mechanisms 16. Specifically, a part of the extending portion 30*b* of the plate spring 30 extends through a space 27 sandwiched between the pair of receiving seats 21 and 22 and further extends under the coupling plate 23 to reach a position under the cross beam 4.

Figure 4:
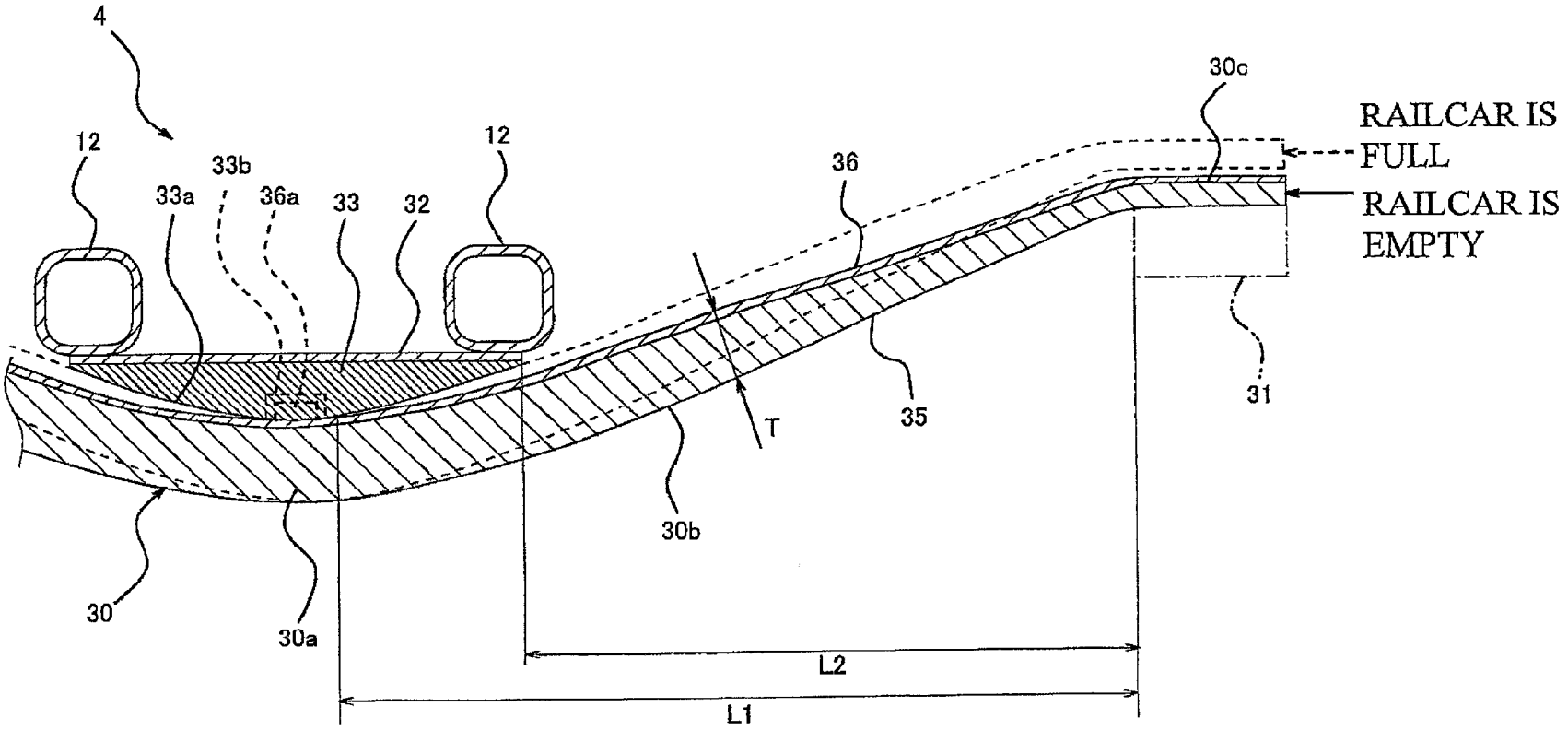
FIG. 4 is a main portion cross-sectional view taken along line IV-IV of FIG. 2 and showing a contact member of a cross beam and a plate spring.
Figure 5:
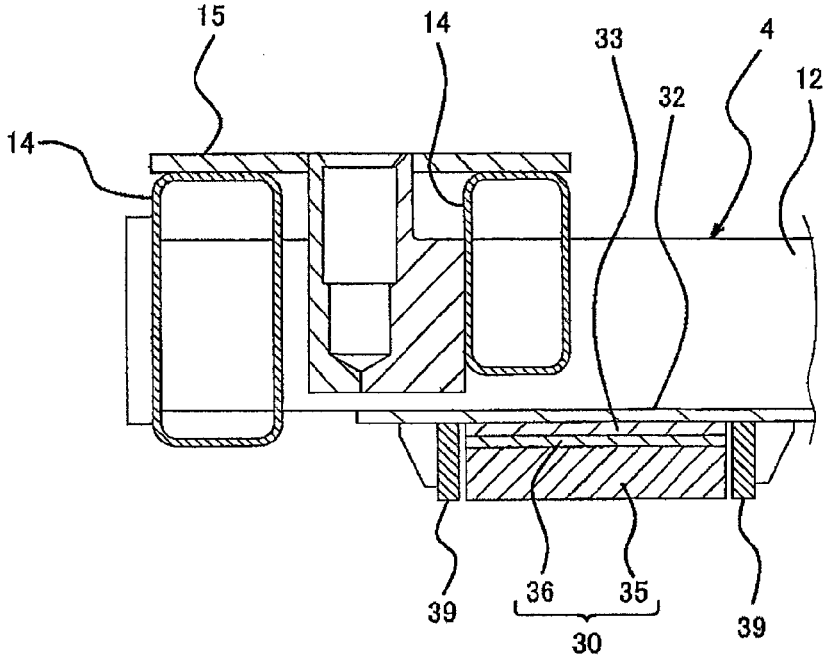
FIG. 5 is a cross-sectional view taken along line v-v of FIG. 2.

FIG. 4 is a main portion cross-sectional view taken along line IV-IV of FIG. 2 and showing the contact member 33 of the cross beam 4 and the plate spring 30. FIG. 5 is a cross-sectional view taken along line V-V of FIG. 2. As shown in FIG. 4, a fixing plate 32 fixed to lower surfaces of the pair of square pipes 12 and made of metal (such as a general steel material) and the contact member 33 fixed to a lower surface of the fixing plate 32 and constituted by a stiff member (such as a non-elastic member made of metal, fiber-reinforced resin, or the like) are provided at each of the crosswise direction end portions 4*a* of the cross beam 4. The contact member 33 does not support a lower surface of the plate spring 30, that is, the lower surface of the plate spring 30 is in an exposed state. To be specific, the contact member 33 is disposed on the front-rear direction middle portion 30*a* of the plate spring 30 from above so as to freely contact the front-rear direction middle portion 30*a*. In other words, the contact member 33 separably contacts an upper surface of the plate spring 30 so as not to be fixed to the plate spring 30 in the upper-lower direction. To be specific, the contact member 33 is not fixed to the plate spring 30 by fixtures, but the contact between the contact member 33 and the upper surface of the plate spring 30 is being maintained by contact pressure generated by a downward load applied from the cross beam 4 by gravity and a reaction force of the plate spring 30 with respect to the downward load. As shown in FIG. 5, a pair of guide side walls 39 respectively projecting downward from both crosswise direction sides of the contact member 33 are provided at the cross beam 4 so as to be spaced apart from each other, and the plate spring 30 is arranged between the guide side walls 39 so as to be spaced apart from the guide side walls 39.

As shown in FIG. 4, each of the front-rear direction end portions 30*c* of the plate spring 30 is located at a position higher than a contact surface 33*a* that is a lower surface of the contact member 33 of the cross beam 4. The contact surface 33*a* contacting the plate spring 30 has a substantially circular-arc shape that is convex downward in a side view. In a state where the bogie 1 is not supporting the carbody 11, the curvature of the contact surface 33*a* of the contact member 33 is larger than that of a portion of the plate spring 30 in a side view, the portion contacting the contact member 33. In a state where the bogie 1 is supporting the carbody 11, the plate spring 30 elastically deforms by the downward load from the carbody 11 such that the cross beam 4 moves downward, and the curvature of the portion, contacting the contact member 33, of the plate spring 30 increases. However, when the railcar is empty, the curvature of the contact surface 33*a* of the contact member 33 is kept larger than that of the portion, contacting the contact member 33, of the plate spring 30 (solid line in FIG. 4).

As the number of passengers in the carbody 11 increases, and this increases the downward load applied to the cross beam 4, the curvature of the portion, contacting the contact member 33, of the plate spring 30 increases. To be specific, as the downward load applied to the cross beam 4 increases, the plate spring 30 elastically deforms, and the contact area between the plate spring 30 and the contact member 33 increases. Thus, a shortest distance from a portion, contacting the contact member 33, of the plate spring 30 to a portion, contacting the supporting member 31, of the plate spring 30 changes from L1 to L2, that is, becomes short (broken line in FIG. 4). Thus, as the vehicle occupancy of the carbody 11 increases, and this increases the downward load applied to the cross beam 4, the spring constant of the plate spring 30 increases. As above, the spring constant changes in accordance with the change in the vehicle occupancy. Therefore, a railcar that is high in ride quality both when the vehicle occupancy is low and when the vehicle occupancy is high is realized.

The plate spring 30 has a double-layer structure and includes a lower layer portion 35 made of fiber-reinforced resin (such as CFRP or GFRP) and an upper layer portion 36 that is thinner than the lower layer portion 35 and made of metal (such as a general steel material). In other words, the plate spring 30 is formed such that an upper surface of a plate spring main body portion (lower layer portion 35) made of fiber-reinforced resin is integrally covered with metal (upper layer portion 36). The extending portion 30*b* of the plate spring 30 is formed such that a thickness T thereof gradually increases in a direction from a front-rear direction end portion toward a middle portion. Specifically, in the extending portion 30*b* of the plate spring 30, the thickness of the lower layer portion 35 gradually increases in a direction from the front-rear direction end portion toward the middle portion, and the thickness of the upper layer portion 36 is constant. For example, the thickness of a thinnest portion of the lower layer portion 35 is 3 to 10 times the thickness of a thinnest portion of the upper layer portion 36, and the thickness of a thickest portion of the lower layer portion 35 is 5 to 15 times the thickness of a thickest portion of the upper layer portion 36. A concave-convex fitting structure including fitting portions that are fitted to each other in the upper-lower direction with a play is provided at a portion where the contact surface 33*a* of the contact member 33 and the upper surface of the plate spring 30 contact each other. Specifically, a concave portion 33*b* that is concave upward is formed at a middle portion of the contact surface 33*a* of the contact member 33, and a convex portion 36*a* that is fitted to the concave portion 33*b* with a play is formed on an upper surface of the upper layer portion 36 of the plate spring 30.

Figure 6:
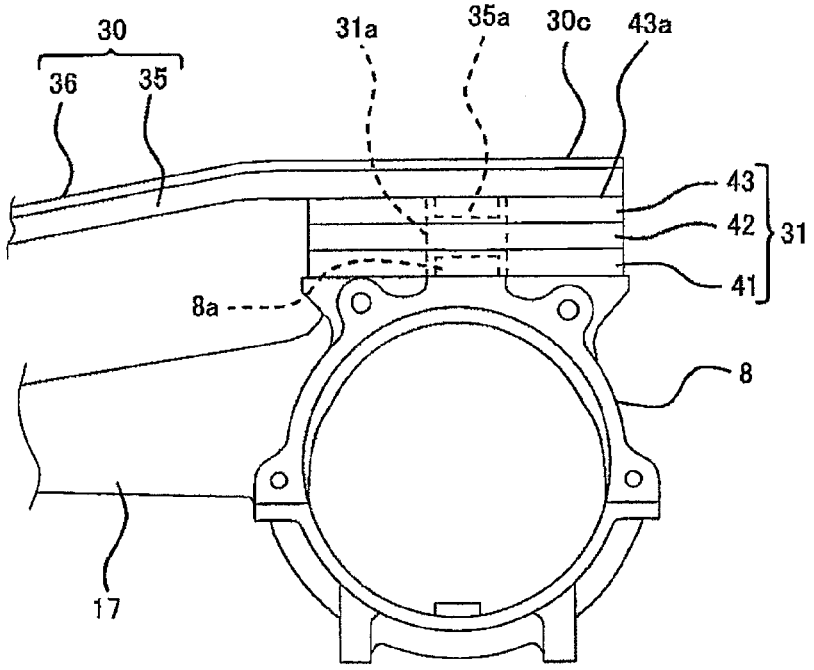
FIG. 6 is a main portion side view showing the plate spring and a supporting member of an axle box in the bogie shown in FIG. 3.

FIG. 6 is a main portion side view showing the plate spring 30 and the supporting member 31 of the axle box 8 in the plate spring bogie 1 shown in FIG. 3. As shown in FIG. 6, the supporting member 31 is disposed on the upper end portion of the axle box 8. A hole portion 31*a* is formed at a center of the supporting member 31, and a convex portion 8*a* provided on the axle box 8 is fitted in the hole portion 31*a*. The supporting member 31 is formed by stacking a rubber plate 41, a metal plate 42, and a rubber plate 43 in this order from below such that these plates 41 to 43 are adhered to one another. That is, a contact surface 43*a*, contacting the lower layer portion 35 made of fiber-reinforced resin, of the supporting member 31 is made of rubber.

The front-rear direction end portion 30*c* of the plate spring 30 is disposed on the supporting member 31 from above so as to freely contact the supporting member 31. In other words, the front-rear direction end portion 30*c* of the plate spring 30 contacts an upper surface of the supporting member 31 so as not to be fixed to the supporting member 31 in the upper-lower direction. To be specific, the front-rear direction end portion 30*c* of the plate spring 30 is not fixed to the supporting member 31 by fixtures, but the contact between the front-rear direction end portion 30*c* and the upper surface of the supporting member 31 is being maintained only by contact pressure generated by the downward load applied from the plate spring 30 and the reaction force of the supporting member 31 with respect to the downward load. A concave-convex fitting structure including fitting portions that are fitted to each other in the upper-lower direction with a play is provided at a portion where a contact surface 43*a* (upper surface) of the supporting member 31 and the lower surface of the plate spring 30 contact each other. Specifically, a convex portion 35*a* projecting downward integrally from the lower layer portion 35 is formed at the front-rear direction end portion 30*c* of the plate spring 30, and the convex portion 35*a* is fitted in the hole portion 31*a* of the supporting member 31 with a play.

According to the configuration explained as above, the contact member 33 of the cross beam 4 is disposed on the front-rear direction middle portion 30*a* of the plate spring 30 from above and freely contacts the upper surface of the plate spring 30 so as not to be fixed to the plate spring 30 in the upper-lower direction. Similarly, the front-rear direction end portion 30*c* of the plate spring 30 is disposed on the supporting member 31 of the axle box 8 from above and freely contacts the upper surface of the supporting member 31 so as not to be fixed to the supporting member 31 in the upper-lower direction. Therefore, a supporting structure between the plate spring 30 and the cross beam 4 and a supporting structure between the plate spring 30 and the axle box 8 are simplified, and the assembly workability of the bogie 1 significantly improves.

Further, the contact member 33 of the cross beam 4 is not fixed to the plate spring 30 in the upper-lower direction but contacts the plate spring 30, and the supporting member 31 of the axle box 8 is not fixed to the plate spring 30 in the upper-lower direction but contacts the plate spring 30. Therefore, the torsional force is transmitted little between the cross beam 4 and the plate spring 30 and between the plate spring 30 and the axle box 8. Therefore, it is unnecessary to increase the strengths of respective members and reinforce the bogie 1 as countermeasures against the torsion. Thus, the weight reduction of the bogie can be accelerated. Since the torsional force is transmitted little between the cross beam 4 and the plate spring 30 and between the plate spring 30 and the axle box 8, it is possible to prevent wheel unloading of a part of a plurality of wheels 6.

Further, unlike metal, it is difficult to recycle fiber-reinforced resin. However, since the fiber-reinforced resin is used for the plate spring 30 that can be easily separated from other parts, the recyclability of the other members made of metal can be maintained high. The plate spring 30 contacts the contact member 33 via the upper layer portion 36 that is a covering member made of metal, and the lower layer portion 35 made of the fiber-reinforced resin in the plate spring 30 contacts the rubber plate 43 of the supporting member 31. Therefore, the fiber-reinforced resin of the plate spring 30 can be protected.

When the downward load applied to the cross beam 4 increases, and this causes the elastic deformation of the plate spring 30, a compressive stress is generated at the upper surface of the plate spring 30. Generally, the compressive strength of the fiber-reinforced resin is lower than the tensile strength thereof. In the present embodiment, the upper layer portion 36 is made of metal whose compressive strength is higher than the compressive strength of the fiber-reinforced resin of the lower layer portion 35. Therefore, when the plate spring 30 elastically deforms, the upper layer portion 36 firmly fixed to the lower layer portion 35 can reinforce the lower layer portion 35 made of the fiber-reinforced resin. Further, the plate spring 30 is arranged such that a part thereof overlaps the receiving seats 21 and 22 of the coupling mechanism 16 in a side view. Therefore, upper-lower direction occupied spaces of the plate spring 30 and the coupling mechanism 16 can be reduced. Since the front-rear direction middle portion 30*a* of the plate spring 30 is located at a position lower than the front-rear direction end portions 30*c* of the plate spring 30, the cross beam 4 can be arranged at a low position, and this can contribute to the lowering of the height of the floor of the railcar.

Since the concave-convex fitting structures each configured to realize fitting in the upper-lower direction with a play are respectively provided at the portion where the contact member 33 and the plate spring 30 contact each other and the portion where the plate spring 30 and the supporting member 31 contact each other, the workability at the time of assembly improves, and the positional displacement in a horizontal direction can be prevented. Without providing the concave-convex fitting structure between the contact member 33 and the plate spring 30, the contact member 33 may be disposed on the plate spring 30 so as not to be fixed to the plate spring 30 not only in the upper-lower direction but also in the horizontal direction.

Embodiment 2

Figure 7:
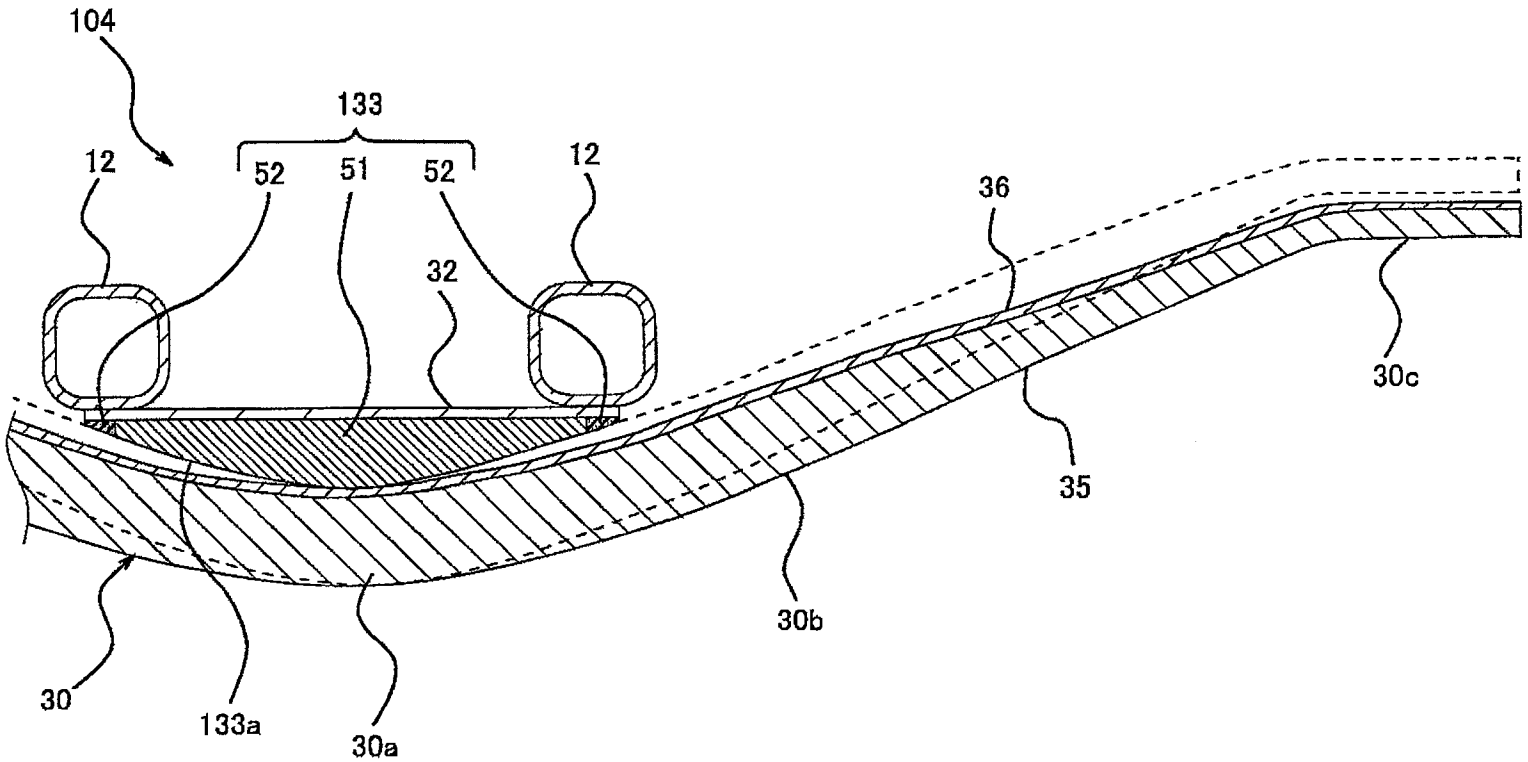
FIG. 7 is a diagram showing the bogie according to Embodiment 2 of the present invention and corresponds to FIG. 4.

FIG. 7 is a diagram showing the bogie including plate springs according to Embodiment 2 of the present invention and corresponds to FIG. 4. As shown in FIG. 7, in the bogie of Embodiment 2, elastic members 52 (such as rubber) are respectively provided at front-rear direction end portions of a contact member 133 of a cross beam 104. Specifically, the contact member 133 includes: a main body portion 51 constituted by a stiff member (such as a non-elastic member made of metal, fiber-reinforced resin, or the like) fixed to the lower surface of the fixing plate 32 fixed to the square pipes 12; and the elastic members 52 respectively arranged at both front-rear direction sides of the main body portion 51 so as to be adjacent to the main body portion 51. Lower surfaces of the main body portion 51 and the elastic members 52 constitute a contact surface 133*a* that is smoothly continuous, is convex downward, and has a substantially circular-arc shape in a side view. With this, even if the plate spring 30 elastically deforms by the increase in the downward load applied to the cross beam 104 to contact the front-rear direction end portions of the contact member 133, local loads applied to the plate spring 30 can be appropriately reduced by the elastic members 52. Since the other components herein are the same as those in Embodiment 1, explanations thereof are omitted.

Embodiment 3

Figure 8:
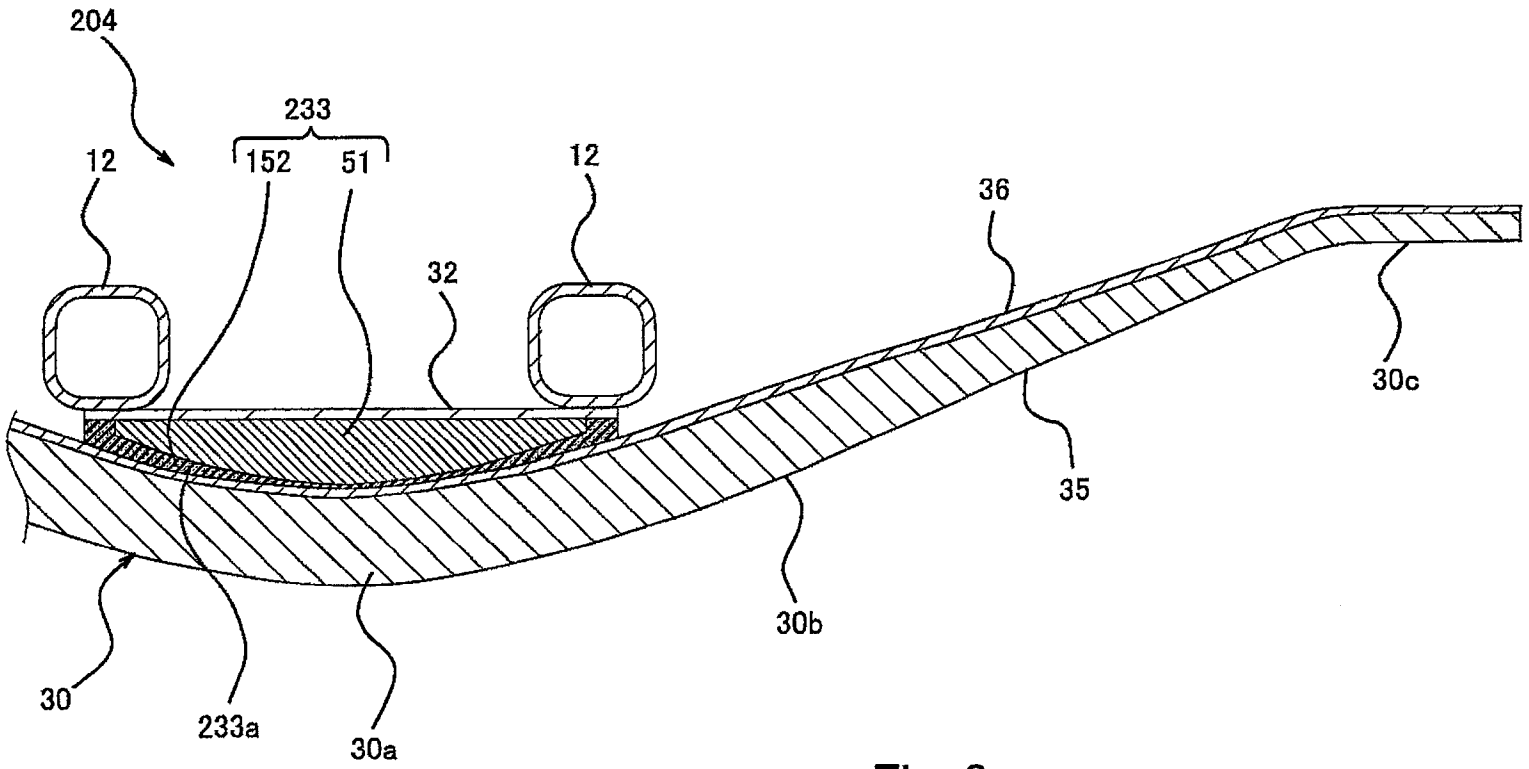
FIG. 8 is a diagram showing the bogie according to Embodiment 3 of the present invention and corresponds to FIG. 4.

FIG. 8 is a diagram showing the bogie including plate springs according to Embodiment 3 of the present invention and corresponds to FIG. 4. As shown in FIG. 8, in the bogie of Embodiment 3, an elastic member 152 (such as rubber) surface-contacting the upper surface of the plate spring 30 is located at a lower surface of a contact member 233 of a cross beam 204. Specifically, the contact member 233 includes: the main body portion 51 constituted by the stiff member (such as a non-elastic member made of metal, fiber-reinforced resin, or the like) fixed to the lower surface of the fixing plate 32 fixed to the square pipes 12; and an elastic member 152 covering a lower surface and front-rear direction ends of the main body portion 51. The lower surface of the main body portion 51 has a substantially circular-arc shape that is convex downward in a side view, and a lower surface of the elastic member 152 forms a contact surface 233*a* having a substantially circular-arc shape that is convex downward in a side view.

In a state where the bogie is not supporting the carbody, the entire contact surface 233*a* (lower surface) of the elastic member 152 contacts the upper surface of the plate spring 30. In a case where the number of passengers in the carbody supported by the bogie increases, and this increases the downward load applied to the cross beam 204, the curvature (deflection) of the front-rear direction middle portion 30*a* of the plate spring 30 increases, and the contact surface 233*a* of the elastic member 152 is pressed against the upper surface of the plate spring 30. Thus, both front-rear direction side portions of the elastic member 152 mainly contract. In contrast, in a case where the downward load applied to the cross beam 204 decreases, and this decreases the curvature (deflection) of the front-rear direction middle portion 30*a* of the plate spring 30, the front-rear direction side portions of the elastic member 152 mainly expand by the decrease in the compressive force. With this, a state where the entire contact surface 233*a* of the contact member 233 surface-contacts the upper surface of the plate spring 30 is maintained. Therefore, a gap is not formed between the contact surface 233*a* of the contact member 233 and the plate spring 30. On this account, dirt and the like can be prevented from getting into the gap.

As the downward load applied to the cross beam 204 increases, and this increases the curvature of the plate spring 30, the contact pressure between the plate spring 30 and each of the front-rear direction side portions of the elastic member 152 increases. Therefore, it is possible to obtain the same effect as a case where a front-rear direction length of an unrestricted portion of the extending portion 30*b* of the plate spring 30 becomes practically short. On this account, the spring constant of the plate spring 30 increases. Thus, the spring constant changes in accordance with the change in the vehicle occupancy. Therefore, a railcar that is high in ride quality both when the vehicle occupancy is low and when the vehicle occupancy is high is realized. Since the other components herein are the same as those in Embodiment 1, explanations thereof are omitted.

Embodiment 4

Figure 9:
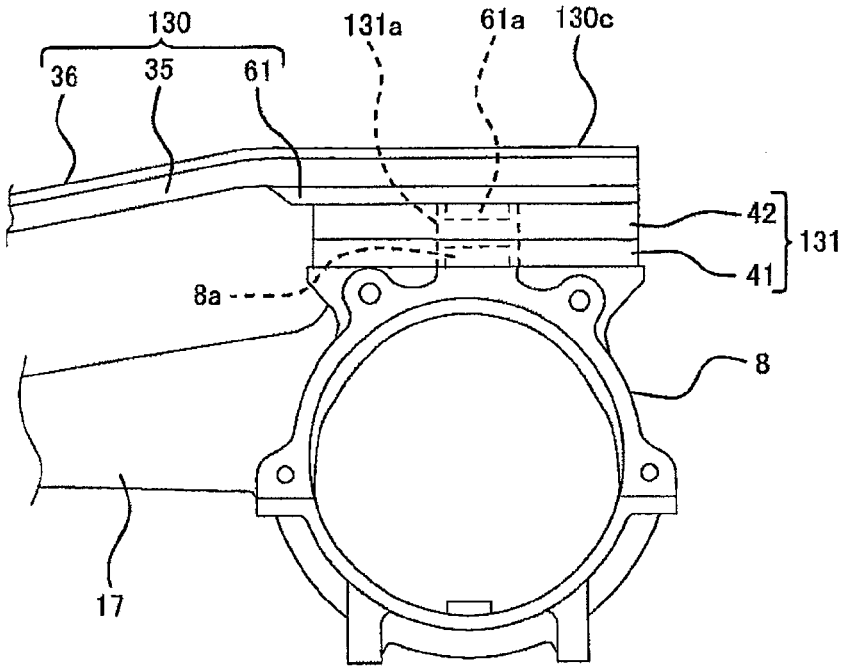
FIG. 9 is a diagram showing the bogie according to Embodiment 4 of the present invention and corresponds to FIG. 6.

FIG. 9 is a diagram showing the bogie including plate springs according to Embodiment 4 of the present invention and corresponds to FIG. 6. As shown in FIG. 9, in the bogie of Embodiment 4, rubber plates 61 are firmly fixed to a lower surface of the lower layer portion 35 made of fiber-reinforced resin so as to be respectively located at front-rear direction end portions 130*c* of a plate spring 130 (side member). A supporting member 131 provided at the upper end portion of the axle box 8 is formed by stacking the rubber plate 41 and the metal plate 42 in this order from below. To be specific, an upper surface of the supporting member 131 is made of metal, but a lower surface of the front-rear direction end portion 130*c* of the plate spring 130 is made of rubber. Therefore, the lower layer portion 35 made of the fiber-reinforced resin in the plate spring 130 can be appropriately protected. Since the other components herein are the same as those in Embodiment 1, explanations thereof are omitted.

Embodiment 5

Figure 10:
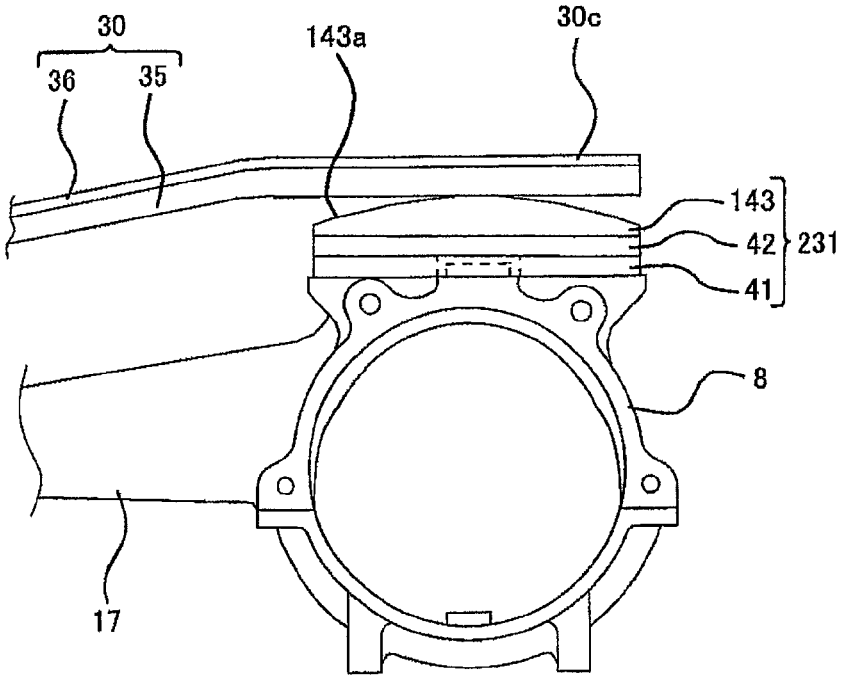
FIG. 10 is a diagram showing the bogie according to Embodiment 5 of the present invention and corresponds to FIG. 6.

FIG. 10 is a diagram showing the bogie including plate springs according to Embodiment 5 of the present invention and corresponds to FIG. 6. As shown in FIG. 10, in the bogie of Embodiment 5, an upper surface of a supporting member 231 provided at the upper end portion of the axle box 8 is formed in a substantially circular-arc shape that is convex upward in a side view. Specifically, the supporting member 231 is formed by stacking the rubber plate 41, the metal plate 42, and a rubber plate 143 in this order from below. An upper surface 143*a* of the rubber plate 143 that is an uppermost layer is formed in a substantially circular-arc shape in a side view. That is, in a side view, the curvature of the upper surface 143*a* of the supporting member 231 is larger than that of a lower surface of a portion (front-rear direction end portion 30*c*), contacting the supporting member 231, of the plate spring 30. With this, as the downward load applied to the cross beam 4 (FIG. 4) increases, and this causes the elastic deformation of the plate spring 30, the shortest distance from the portion, contacting the contact member 33 (FIG. 4), of the plate spring 30 to a portion, contacting the supporting member 231, of the plate spring 30 becomes short. Therefore, as the vehicle occupancy of the carbody 11 increases, the spring constant of the plate spring 30 increases. Thus, the spring constant changes in accordance with the change in the vehicle occupancy. Therefore, a railcar that is high in ride quality both when the vehicle occupancy is low and when the vehicle occupancy is high can be realized. Since the other components herein are the same as those in Embodiment 1, explanations thereof are omitted.

Embodiment 6

Figure 11:
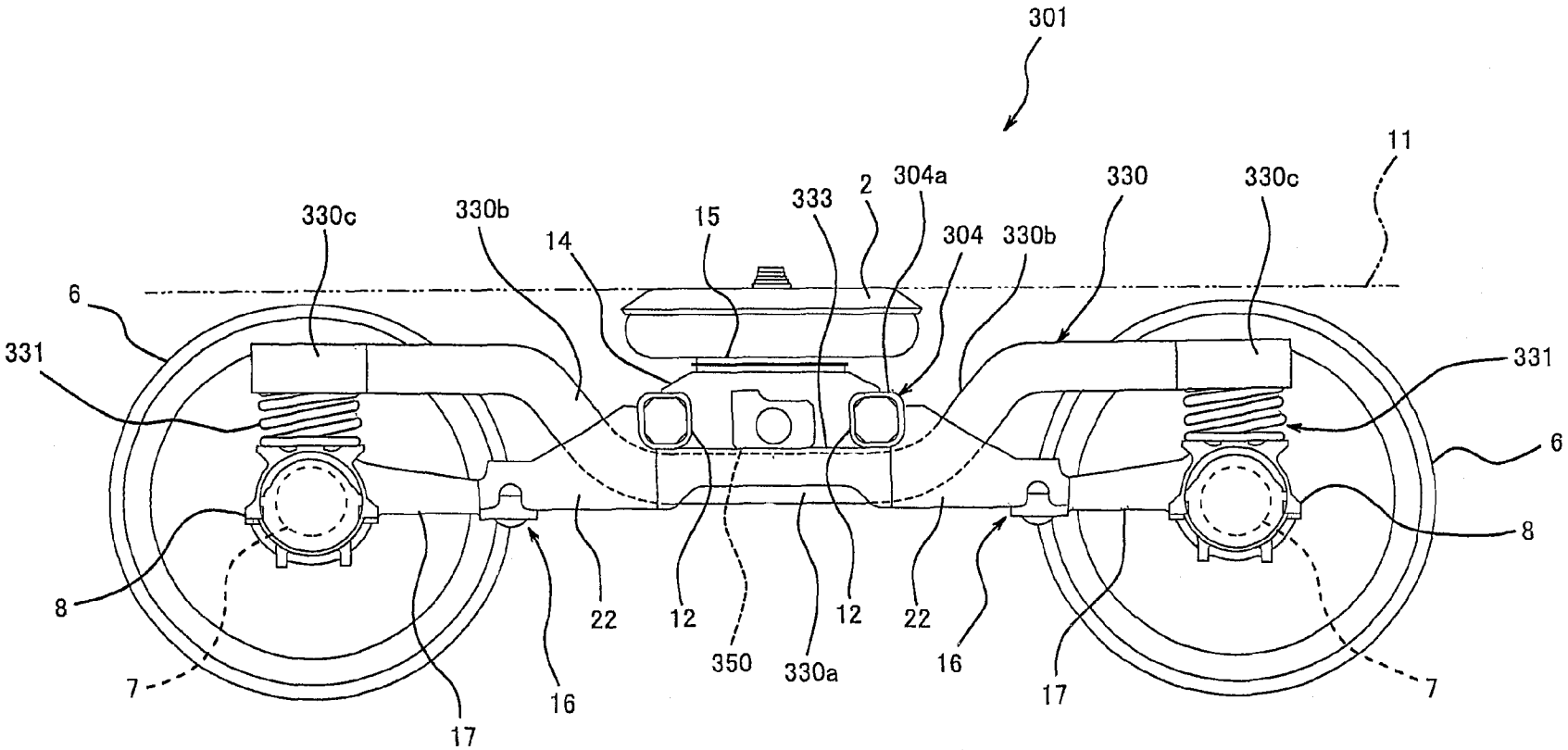
FIG. 11 is a diagram showing the bogie according to Embodiment 6 of the present invention and corresponds to FIG. 3.

FIG. 11 is a diagram showing a bogie 301 according to Embodiment 6 of the present invention and corresponds to FIG. 3. As shown in FIG. 11, instead of the plate springs 30, the bogie 301 of Embodiment 6 includes elongated members 330 (side members) each constituted by a stiff member (such as a non-elastic member made of metal, fiber-reinforced resin, or the like) and extending in the front-rear direction. The elongated member 330 has, for example, a tubular shape. Each of the elongated members 330 includes: a front-rear direction middle portion 330*a* supporting a crosswise direction end portion 304*a* of a cross beam 304; front-rear direction end portions 330*c* respectively supported by the axle boxes 8 and located at positions higher than the middle portion 330*a*; and inclined portions 330*b* each connecting the middle portion 330*a* and each of the end portions 330*c*. To be specific, in the elongated member 330, the middle portion 330*a* and a pair of inclined portions 330*b* respectively located in front of and behind the middle portion 330*a* form a concave portion. Each of coil springs 331 as primary suspensions is interposed between the end portion 330*c* of the elongated member 330 and the axle box 8. A part of the inclined portion 330*b* of the elongated member 330 is arranged so as to overlap the coupling mechanism 16 in a side view. Specifically, a part of the inclined portion 330*b* of the elongated member 330 is inserted through the space 27 (see FIG. 1) sandwiched between the pair of receiving seats 21 and 22.

Contact members 333 as bottom walls are respectively provided at the crosswise direction end portions 304*a* of the cross beam 304. Each of the contact members 333 of the crosswise direction end portions 304*a* of the cross beam 304 does not support a lower surface of the elongated member 330, that is, the lower surface of the elongated member 330 is in an exposed state. That is, the contact member 333 is disposed on the middle portion 330*a* of the elongated member 330 from above via a rubber plate 350. To be specific, the contact member 333 is not fixed to the elongated member 330 by fixtures and is separably disposed on the elongated member 330. The integrated state between the contact member 333 and the elongated member 330 is being maintained by the contact pressure generated by the downward load applied from the cross beam 4 by gravity and the reaction force of the elongated member 330 with respect to the downward load.

As above, the contact member 333 of the cross beam 304 is disposed on the elongated member 330 from above and is not fixed to the elongated member 330 in the upper-lower direction. Therefore, the supporting structure between the elongated member 330 and the cross beam 304 is simplified. Thus, the assembly workability of the bogie significantly improves. Further, since the contact member 333 of the cross beam 304 is not fixed to the elongated member 330 in the upper-lower direction, the torsional force is transmitted little between the cross beam 304 and the elongated member 330. Therefore, it is unnecessary to increase the strengths of respective members and reinforce the bogie as countermeasures against the torsion. Thus, the weight reduction of the bogie can be accelerated. In addition, since the torsional force is transmitted little between the cross beam 304 and the elongated member 330, it is possible to prevent the wheel unloading of a part of the plurality of wheels 6.

The contact member 333 and the elongated member 330 may respectively include fitting portions that are fitted to each other in the upper-lower direction. With this, the relative movement of the contact member 333 and the elongated member 330 in the horizontal direction may be restricted in a state where the contact member 333 and the elongated member 330 are not fixed in the upper-lower direction.

Embodiment 7

Figure 12:
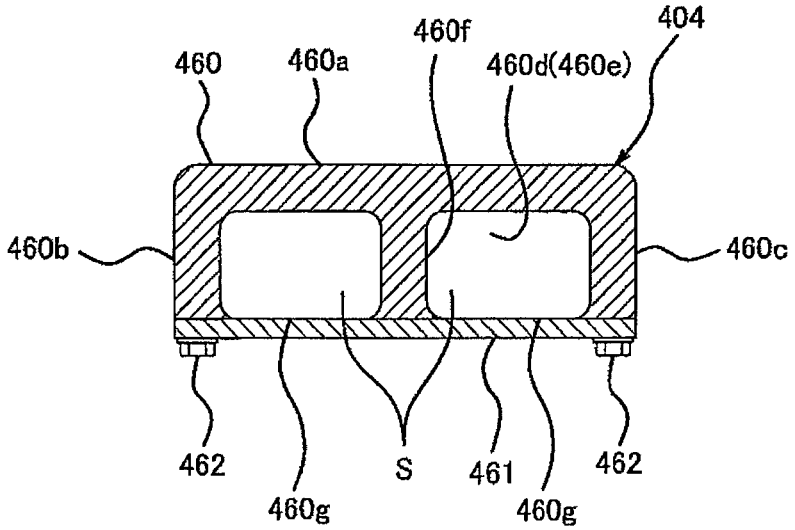
FIG. 12 is a cross-sectional view showing the bogie according to Embodiment 7 of the present invention when viewed from a lateral side of the cross beam.

FIG. 12 is a cross-sectional view showing a cross beam 404 of the bogie according to Embodiment 7 of the present invention when viewed from a lateral side (left-right direction). As shown in FIG. 12, the cross beam 404 of Embodiment 7 includes: a cross beam main body 460 made by a cutting work of metal; and a plate-shaped lid 461 closing an opening portion 460*g* formed on a worked surface of the cross beam main body 460. The cross beam main body 460 is made in such a manner that a concave space S is formed by the cutting work with respect to one surface (in the present embodiment, a lower surface) of a hexahedron that is made of metal and long in the crosswise direction. With this, the cross beam main body 460 includes five outer wall portions that are an upper wall portion 460*a*, a front wall portion 460*b*, a rear wall portion 460*c*, a right wall portion 460*d*, and a left wall portion 460*e*. In addition, the cross beam main body 460 includes an inner wall portion 460*f* dividing the concave space S. The lid 461 is attached to a lower surface of the cross beam main body 460 so as to close the opening portion 460*g* of the concave space S. The lid 461 is a plate that is thinner than the cross beam main body 460. The lid 461 is fixed to the cross beam main body 460 by fixtures (such as bolts or screws). To be specific, the cross beam 404 can be made without welding. Corner portions of the outer surfaces and inner surfaces of the cross beam main body 460 are rounded by chamfering.

With this configuration, the cross beam 404 can be automatically made with a cutting machine, works requiring skills, such as welding, are unnecessary. Therefore, the producibility and the manufacturing accuracy improve. By the combination of this configuration and a configuration in which the cross beam 404 is not welded to the side member (the plate spring 30 or the elongated member 330), an operation of eliminating cumulative distortion caused by welding is significantly reduced. Thus, the producibility can be dramatically improved.

Embodiment 8

Figure 13:
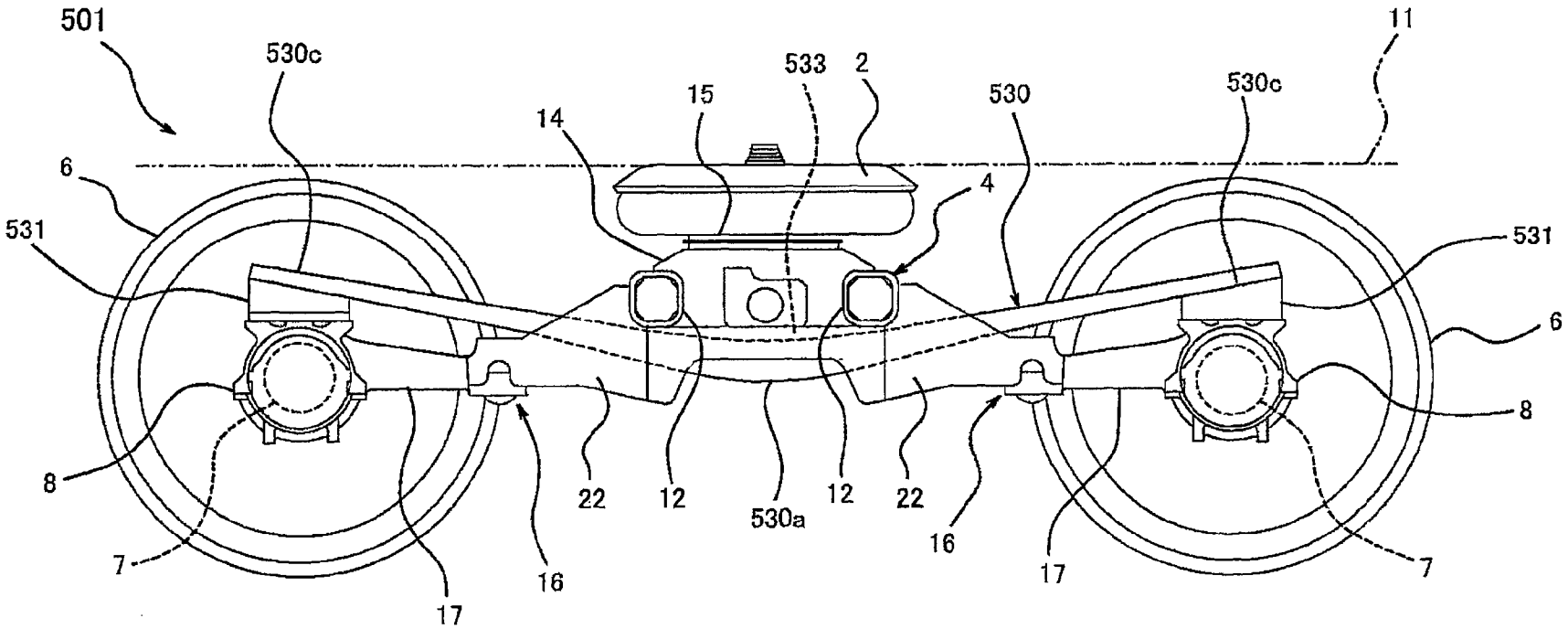
FIG. 13 is a side view of the bogie according to Embodiment 8 of the present invention.
Figure 14:
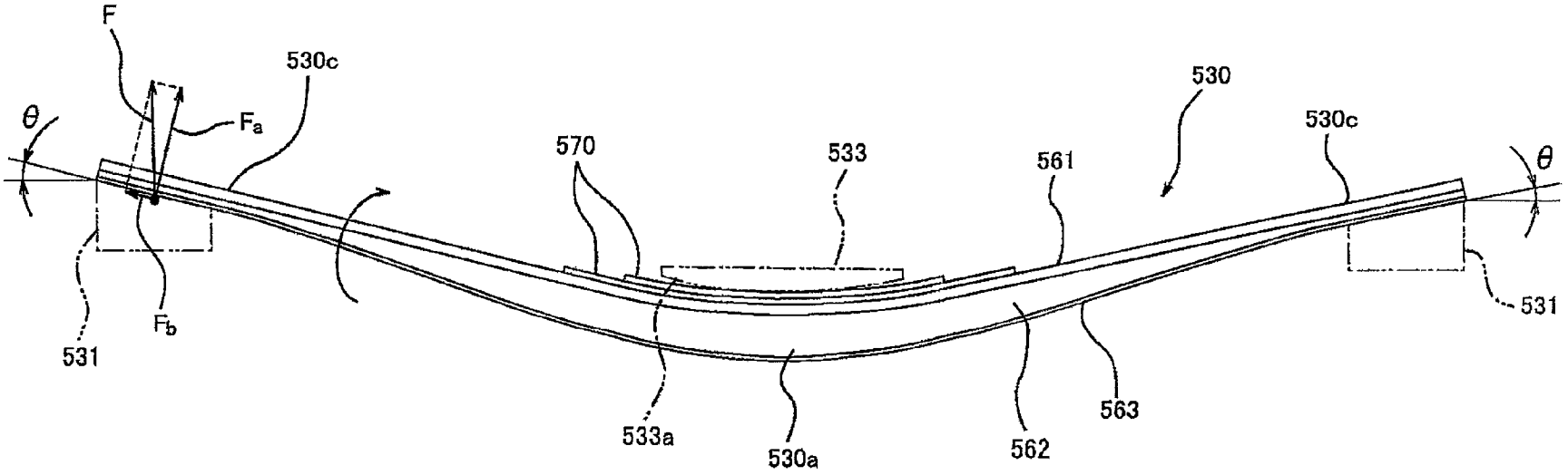
FIG. 14 is a side view of the plate spring in the bogie shown in FIG. 13.

FIG. 13 is a side view of a bogie 501 according to Embodiment 8 of the present invention. FIG. 14 is a side view of a plate spring 530 in the bogie 501 shown in FIG. 13. As shown in FIGS. 13 and 14, the bogie 501 of Embodiment 8 includes the plate springs 530 each formed in an arch shape that is convex downward as a whole in a side view. The plate spring 530 is formed such that, in a side view, a longitudinal direction middle portion 530*a* thereof has a circular-arc shape projecting downward, and longitudinal direction end portions 530*c* thereof curve upward. Therefore, lower surfaces of the longitudinal direction end portions 530*c* of the plate spring 530 are flat but inclined relative to a horizontal surface. To be specific, each of the lower surfaces of the longitudinal direction end portions 530*c* is inclined so as to become higher toward the outside in the railcar longitudinal direction.

Supporting members 531 are respectively attached to the upper end portions of the axle boxes 8. The longitudinal direction end portions 530*c* of the plate spring 530 are respectively disposed on upper surfaces of the supporting members 531 from above. Upper surfaces of the supporting members 530 are inclined relative to the horizontal surface so as to respectively correspond to the longitudinal direction end portions 530*c* of the plate spring 530. Contact members 533 each having a circular-arc lower surface 533*a* are respectively provided at lower portions of the railcar width direction end portions 4*a* of the cross beam 4. The contact members 533 are respectively disposed on and freely contact the longitudinal direction middle portions 530*a* of the plate springs 530. The contact member 533 and the plate spring 530 do not respectively include fitting portions that are fitted to each other in the upper-lower direction. An interposed sheet 570 (such as a rubber sheet) contacting the contact member 533 is disposed on an upper surface of the longitudinal direction middle portion 530*a* of the plate spring 530.

As shown in FIG. 14, the plate spring 530 includes an upper layer 561, an intermediate layer 562, and a lower layer 563, and the volume of the intermediate layer 562 is larger than the sum of the volume of the upper layer 561 and the volume of the lower layer 563. The upper layer 561 and the lower layer 563 are made of CFRP, and the intermediate layer 562 is made of GFRP. CFRP is higher in tensile strength and compressive strength than GFRP. The thickness of the plate spring 530 is set so as to become gradually thinner in a direction from the longitudinal direction middle portion 530*a* toward the longitudinal direction end portion 530*c*. The thickness of the intermediate layer 562 is set so as to become gradually thinner in a direction from the longitudinal direction middle portion 530*a* toward the longitudinal direction end portion 530*c*. The thickness of the upper layer 561 and the thickness of the lower layer 563 are constant, and the upper layer 561 is thicker than the lower layer 563.

When the carbody 11 supported by the bogie 1 is empty, an inclination angle θ of the longitudinal direction end portion 530*c* of the plate spring 530 relative to the horizontal surface is set to not smaller than 10° and not larger than 25° (for example, 15°). While the railcar is running, upper-lower, front-rear, and left-right vibrations are transmitted from the wheels 6 to the bogie frame, and upper-lower vibrational components that have dominant accelerations out of the entire vibrational components are transmitted and absorbed by the plate springs 530. At this time, since the lower surface of the longitudinal direction end portion 530*c* of the plate spring 530 is inclined, an upward force F transmitted from the supporting member 531 to the plate spring 530 by the vibrations is divided into a vertical component force Fa that is vertical relative to the longitudinal direction end portion 530*c* of the plate spring 530 and a horizontal component force Fb that is horizontal relative to the longitudinal direction end portion 530*c* of the plate spring 530. Therefore, the load transmitted from the supporting member 531 to the plate spring 530 decreases from the force F to the component force Fa ($Fa=F\cdot\cos\theta$). The plate spring 530 is not fixed to the contact member 533 and can swing like a seesaw along the circular-arc lower surface 533*a* of the contact member 533. Therefore, when the upper-lower vibrations are applied to one of the longitudinal direction end portions 530*c* of the plate spring 530, the acceleration of the upper-lower vibrations can be absorbed also by the swinging of the plate spring 530 based on the longitudinal direction middle portion 530*a* as a fulcrum. In a case where the inclination angle θ of one of the longitudinal direction end portions 530*c* of the plate spring 530 has become larger than the inclination angle θ of the other of the longitudinal direction end portions 530*c* by the vibrations, the component force Fa of the end portion 530*c* having the larger inclination angle θ becomes lower than the component force Fa of the end portion 530*c* having the smaller inclination angle θ. Therefore, forces act such that the inclination angles θ of both longitudinal direction sides of the plate spring 530 become the same as each other (that is, the plate spring 530 returns to the original posture). Thus, the plate spring 530 has a self correction function to keep the balance.

Further, when the plate spring 530 bends by the upward loads respectively applied from the supporting members 531 to the longitudinal direction end portions 530*c* of the plate spring 530, the curvature of the plate spring 530 increases. Therefore, the longitudinal direction middle portion 530*a* of the plate spring 530 relatively moves downward. Since this downward movement of the longitudinal direction middle portion 530*a* acts in such a direction that the contact member 533 supported by the longitudinal direction middle portion 530*a* of the plate spring 530 moves downward, the downward movement of the longitudinal direction middle portion 530*a* also serves to cancel an upward acceleration component transmitted from the supporting members 531 through the plate spring 530 to the contact member 533. Of course, the plate spring 530 itself has a spring effect. Therefore, the longitudinal direction end portions 530*c* and their vicinities bend to absorb the upward accelerations transmitted from the supporting members 531, so that the plate spring 530 also serves to reduce the transmission of the vibrations to the contact member 533.

The present invention is not limited to the above embodiments, and modifications, additions, and eliminations may be made within the scope of the present invention. In the above embodiment, each of the supporting members 31, 131, and 231 is disposed on the axle box 8 as a separate component but may be configured as a part of the axle box 8. The contact surface, contacting the plate spring 30 or 130, of the contact member 33 or 133 may be made of rubber, and the surface, contacting the rubber, of the plate spring 30 or 130 may be made of fiber-reinforced resin. The entire plate spring may be made of fiber-reinforced resin, or the members other than the plate spring may be made of fiber-reinforced resin. The coupling mechanisms 16 may be omitted as long as the cross beam and the axle boxes are restricted via the side members such that the relative displacement between the cross beam and each axle box in the horizontal direction does not become a predetermined amount or more. The above embodiments may be combined arbitrarily. For example, a part of components or methods in one embodiment may be applied to another embodiment.

INDUSTRIAL APPLICABILITY

As above, the railcar bogie according to the present invention has an excellent effect of being able to improve the assembly workability while simplifying the bogie and reducing the weight of the bogie. Thus, it is useful to widely apply the railcar bogie according to the present invention to railcars that can utilize the significance of the above effect.

REFERENCE SIGNS LIST

1, 301, 501 railcar bogie
4, 104, 204, 304, 404 cross beam
5 axle
7 bearing
8 axle box
11 carbody
16 coupling mechanism
30, 530 plate spring (side member)
30*a*, 530*a* front-rear direction middle portion
30*c*, 530*c* front-rear direction end portion
31, 131, 231, 531 supporting member
33, 133, 233, 333, 533 contact member
33*a* contact surface
33*b* concave portion
35 lower layer portion
35*a* convex portion
36 upper layer portion
36*a* convex portion
330 elongated member (side member)

The invention claimed is:

1. A railcar bogie comprising:

a cross beam supporting a carbody of a railcar;

axle boxes respectively accommodating bearings respectively provided at both railcar-width-direction sides of each of axles;

plate springs extending in a railcar longitudinal direction from a front to a back of the railcar bogie, both railcar-longitudinal-direction end portions of each of the plate springs respectively being supported above the axle boxes, railcar-longitudinal-direction middle portions of the plate springs disposed below the cross beam so as not to be fixed to the cross beam; and contact members respectively disposed between both railcar-width-direction end portions of the cross beam, each of the plate springs swinging in a pitch direction along a lower surface of each of the contact members when a load is applied to one of the railcar-longitudinal-direction end portions of each of the plate springs.

2. The railcar bogie according to claim 1, further comprising:

supporting members are respectively provided at upper end portions of the axle boxes, upper surfaces of the supporting members being inclined relative to a horizontal plane so as to respectively correspond to the railcar-longitudinal-direction end portions of the plate springs.

3. The railcar bogie according to claim 1, further comprising:

supporting members respectively provided at the axle boxes and respectively supporting the railcar-longitudinal-direction end portions of the plate springs so as not to be fixed to the plate springs by fixtures in the upper-lower direction.

4. A railcar bogie comprising:

a cross beam supporting a carbody of a railcar;

axle boxes respectively accommodating bearings respectively provided at both railcar-width-direction sides of each of axles;

plate springs extending in a railcar longitudinal direction, both railcar-longitudinal-direction end portions of each of the plate springs respectively being supported above the axle boxes, railcar-longitudinal-direction middle portions of the plate springs disposed below the cross beam so as not to be fixed to the cross beam; and contact members respectively disposed between both railcar-width-direction end portions of the cross beam, wherein each of the plate springs swing along a lower surface of each of the contact members when a load is applied to one of the railcar-longitudinal-direction end portions of each of the plate springs, the railcar-longitudinal-direction middle portion of each of the plate springs projects downward and has a circular-arc shape, and each of the lower surfaces of the railcar-longitudinal-direction end portions of the plate springs is included so as to become higher toward an outside of each of the plate springs in the railcar longitudinal direction.

5. A railcar bogie comprising:

a cross beam supporting a carbody of a railcar;

a pair of front and rear axles respectively arranged at both sides of the cross beam in a railcar longitudinal direction so as to extend in a railcar width direction;

bearings respectively provided at both railcar-width-direction sides of each of the axles and rotatably supporting the axles;

axle boxes respectively accommodating the bearings;

plate springs extending in the railcar longitudinal direction and supporting both railcar-width-direction end portions of the cross beam; and contact members respectively provided at the railcar-width-direction end portions of the cross beam, respectively disposed separably on railcar-longitudinal-direction middle portions of the plate springs so as not to be fixed to the plate springs; and supporting members respectively provided at the axle boxes and respectively supporting the railcar-longitudinal-direction end portions of the plate springs, a contact surface of each of the contact members having a substantially circular-arc shape that is convex downward in a side view, the contact surface contacting the plate spring.

* * * * *